US005595529A

United States Patent [19]

Cesna et al.

[11] Patent Number: 5,595,529

[45] Date of Patent: Jan. 21, 1997

[54] DUAL COLUMN ABRADING MACHINE

[75] Inventors: Joseph V. Cesna, Niles, Ill.; Lawrence O. Day, Fremont, Calif.

[73] Assignee: Speedfam Corporation, Des Plaines, Ill.

[21] Appl. No.: 218,611

[22] Filed: Mar. 28, 1994

[51] Int. Cl.[6] ..... B24B 7/24

[52] U.S. Cl. ..... 451/291; 451/287

[58] Field of Search ..... 451/24, 41, 287, 451/290, 291, 285, 286, 269, 268, 289, 288

[56] References Cited

U.S. PATENT DOCUMENTS

| | | | |
|---|---|---|---|
| 1,812,313 | 6/1931 | Arter et al. | 451/12 |
| 2,618,911 | 11/1952 | Indge | 451/287 |
| 2,963,830 | 12/1960 | Hood | 451/288 |
| 4,315,383 | 2/1982 | Day | 51/118 |
| 4,860,498 | 8/1989 | Gosis | 51/165.77 |

*Primary Examiner*—Robert A. Rose
*Attorney, Agent, or Firm*—Fitch, Even, Tabin & Flannery

[57] ABSTRACT

In accordance with the present invention, there is provided a machine for performing abrading operations. The preferred machine includes an upper lap plate and lower lap plate mounted for rotation about its own vertical axis. A carriage means supports the upper lap plate, and a frame means supports the carriage means at spaced locations in a manner permitting the carriage means to reciprocate vertically within the frame means relative to the lower lap plate for performing abrading operations and to provide access for loading and unloading the workpieces. The upper lap plate also may reciprocate vertically and independently of and relative to the carriage means for performing abrading operations and to provide access for loading and unloading the workpieces. Additionally, the abrading machine may be provided with a temperature control device having at least one tube disposed adjacent the lower lap plate for coolant fluid flow. The device includes means for reversing the coolant flow supply from the inlet to the outlet while the abrading device is operational for effectuating more even temperature control across the lap plates. The abrading machine also may be provided with an abrasive fluid distribution system having a plurality of ring-like troughs being mountable above the upper lap plate concentrically and which are spaced radially from one another to supply abrasive fluid uniformly to the lapping surfaces. Each trough is provided with a plurality of passages that are positioned in a circumferentially staggered relation to uniformly supply abrasive fluid from the troughs to the lapping surfaces.

15 Claims, 4 Drawing Sheets

DUAL COLUMN ABRADING MACHINE

FIELD OF THE INVENTION

This invention relates to a two wheel lapping or finishing machine, and more particularly, to a dual column design machine in which a moveable bridge is well supported by two columns and includes an upper lap plate vertically moveable relative to the bridge to provide a low silhouette for greater control during machining operations.

BACKGROUND OF THE INVENTION

It has long been known to use precision abrading processes to bring workpiece surfaces to a desired state of refinement or dimensional tolerance. This is done commonly by using a process known as lapping which removes small, controlled amounts of material with a fine abrasive grit rubbed about it in a random manner. Generally, a loose unbonded grit is employed and is mixed with a vehicle such as oil, grease, or soap and water compound. Although some lapping or finishing is done by hand, most production work is done on a lapping or finishing machine. Hence, it is desirable to employ highly effective lapping and finishing machines for precisely machining these workpiece surfaces to within relatively diminutive dimensional tolerances, which today are within microns. The concerns discussed herein are made referencing lapping machines, but also apply to finishing and polishing machines.

Many lapping machines today employ a fixed bridge supported by dual columns. The fixed bridge supports an tipper lap plate for rotation and for vertical movement between a lower lapping position and an upper position for loading and unloading the machine. The distance between these positions is known to be in some instances as much as 14 inches or more in order to load and unload workpiece carriers into the machine. This requires the upper lap plate shaft to be extended as much to set the upper lap plate at its lower lapping position. One known disadvantage to having such long shaft extension is the loss of rigidity and control during the lapping cycle, which in turn results in loss of sizing accuracy. Thus, it is desirable to eliminate such an extension for greater control during the lapping cycle.

Another known disadvantage pertains to the application of pressure during the lapping cycle. Many fixed bridge designs commonly use only a single cylinder to apply pressure from above through the upper lap plate to the lapping cycle. These single cylinder designs tend not to apply sufficient pressure for certain lapping processes.

One known solution in attempting to solve the disadvantages with extending the upper lap plate shaft down such distances includes having the lower lap plate also extend upward to meet the descending upper lap plate. That is, both the upper and lower lap plates move towards one another. Associated with this design are concerns pertaining to sealing gaskets, and the like, for the lower lap plate shaft, and hence the tendency for the abrasive fluid of the lower lap plate to flow downward and damage structure and components, such as bearing assemblies, located below. Also with dual moving lap plates, another known disadvantage is the creation of undesirable budding effects in the system during the lapping cycle.

Other lapping machines use a sliding spindle principle, but are mounted on a single column. These machines eliminate the long extension of the upper lap plate shaft. An example of one such machine is disclosed in U.S. Pat. No. 4,315.383, issued to Lawrence Day on Feb. 16, 1982. Day discloses a machine in which the upper lap plate is associated with an arm which is supported for vertical movement by the single column. To move into the lapping position, the entire arm moves downward to position the upper lap plate, and thereby eliminates the long shaft extension. This design is highly effective for precision lapping to remove an extremely small amount of material, especially when the requisite pressure to perform the particular lapping cycle is not relatively large.

One known shortcoming with the single column design is the generation of a cantilever effect during the lapping cycle. That is, when pressure is exerted during the lapping cycle, the arm and the column tend to act as a cantilever which results in loss of rigidity and control. Hence, sizing accuracy is reduced. Thus, it is desirable to eliminate this cantilevering effect.

Other known problems associated with lapping machines pertains to their cooling system designs. Some lapping machines employ cooling chambers located under the lower lapping plate to provide cooling fluid directly thereto during the lapping cycle. A disadvantage with this design is that the lapping plates by design tend to be sensitive, precision components, and thereby may become distorted by the fluid under high pressure. In performing precision machining such as this, it is critical that the temperature of the lap plates be controlled while also maintaining a substantially planar configuration for the lapping surfaces.

Other lapping machines employ copper coil systems mounted beneath the lower lap plate to control plate temperature during the lapping cycle. An advantage of the copper coil system is that it allows high pressure coolant to go through the system for faster cooling without distorting plate flatness. However, one known shortcoming of present coil designs is the tendency to have non-uniform cooling distribution. That is, the fluid is generally supplied to the coil system at the center of the lapping plate first, and as it proceeds outward through the coil, it warms up due to heat exchange with the lap plate. Consequently, the center regions of the lap plates tend to be colder than the outer regions. Experience reveals that this is especially the case with relatively large lap plates. Thus, it is desirable to have an overall cooling system which includes a more uniform cooling distribution over the lap plates.

Other known disadvantages of lapping machines pertain to distribution of the abrasive slurry used to remove material from the workpieces. Precision lapping and finishing requires optimally that the abrasive slurry be distributed uniformly over the lapping surfaces. This facilitates uniform material removal from the workpieces. However, with non-uniform distribution, the lapping cycle tends to work on the workpieces asymmetrically which results with nonconforming products. Thus, it is desirable to provide an abrasive slurry system which distributes uniformly the abrasive slurry over the lapping surfaces to ensure precise results.

It is the primary object of the present invention to provide a machine with a design that incorporates a low silhouette during the lapping or finishing cycle to facilitate greater rigidity, control and sizing accuracy.

It is another object of the present invention to provide an improved overall cooling system for lapping and finishing machines.

It is a further object of the present invention to provide an improved abrasive slurry distribution system for lapping and finishing machines.

An overall object of the present invention is to provide a lapping or finishing machine having all tile above-mentioned objects to give a complete machine which is highly durable, efficient and cost effective to manufacture, install and operate.

SUMMARY OF THE INVENTION

In accordance with the present invention, there is provided a machine for performing abrading operations, such as lapping or finishing. The preferred machine includes an upper lap plate and lower lap plate which both have lapping surfaces parallel and opposing each other and drive mechanisms, such as motors, for rotating each of the lap plates about its own vertical axis. Workpiece carriers carry at least one workpiece, which is to be machined by the lap plates, on the lower lap plate.

A carriage means supports the upper lap plate, and a frame means supports the carriage means at spaced locations in a manner permitting the carriage means to reciprocate vertically within the frame means. To drive the carriage means vertically, driving means are mounted to the frame and connect to the carriage means to move the upper lap plate relative to the lower lap plate for performing abrading operations and to provide access for loading and unloading the workpieces.

The machine also may include means for vertically reciprocating the upper lap plate independent of and relative to the carriage means for performing abrading operations and to provide access for loading and unloading the workpieces. In combining the independent vertical movements of the carriage means and the upper lap plate, the carriage means may travel a first predetermined distance relative to the lower lap plate, and the upper lap plate may travel a second predetermined distance relative to the carriage means, and the first predetermined distance may be greater than the second predetermined distance. The first distance may also be a fixed distance and the second distance may be a variable distance dependent upon the characteristics of the upper and lower lap plates. A sensing means may be provided for sensing to aid in determining the variable distance of travel.

More particularly, the frame means may comprise a plurality of vertically disposed columns for supporting the carriage means for vertically reciprocating movement. Bearings may be mounted to each column to allow the carriage means to travel vertically therebetween, and an air cylinder may be mounted to each column adjacent the bearings to drive the reciprocating movement of the carriage means.

Additionally, the abrading machine may be provided with a temperature control device having at least one tube disposed adjacent the lower lap plate for coolant fluid flow. The tube includes an inlet centrally located relative to the machine and adjacent the axis of rotation and an outlet located outwardly of the inlet adjacent the outer rotatory portions of the lap plates. Fluid supply lines provide the coolant fluid to the tube and are capable of supplying such at both the inlet and outlet. Also provided is means for reversing the coolant flow supply from the inlet to the outlet while the abrading device is operational for effectuating more even temperature control across the lap plates.

More particularly, the at least one tube may be wound in a spiral configuration about the axis from the inlet to the outlet and may be mounted to the lower lap plate. Further, the at least one tube may be housed in a lower plate located below the lower lap plate.

The abrading machine also may be provided with an abrasive fluid distribution system having a plurality of ring-like troughs being mountable above the upper lap plate concentrically and which are spaced radially from one another to supply abrasive fluid uniformly to the lapping surfaces. A plurality of abrasive fluid supply lines supply the adhesive fluid to each of the troughs. Each trough is provided with a plurality of first passages located at a first radius to extend through the upper lap plate to the upper lapping surface and second passages located at a second radius to extend through the upper lap plate to the upper lapping surface. The second passages are positioned in a circumferentially staggered relation to the first passages, and both passages cooperate to supply abrasive fluid from the troughs to the lapping surfaces. Additionally, the abrasive fluid may be supplied to the ring-like troughs with different supply flow that increase with each trough located outward of the other.

To prevent heat build up between the lap plates, the upper lap plate may be provided with a plurality of passages that extend through the upper lap plate and located adjacent its axis of rotation for allowing heat and steam to escape from between the opposing lapping or polishing surfaces.

The abrading machine may also be provided with a gearlike work carrying means carried on the lower lap plate and gear means in the plane of the lap surface of the lower lap plate for rotating the gearlike work carrying means. There may also be provided means for adjusting vertically the gear means to maintain the gear means in the plane of the lap surface of the lower lap plate as the lower lap plate diminishes in thickness.

The means for adjusting vertically the gear means may include at least one screw which when turned raises and lowers the gear means. The screw may be mounted to a hub assembly for interconnecting the gear means and a shaft for driving the gear means. More particularly, the hub assembly may have radial extensions between which the gear means is disposed and the screw may extend between and through the gear means at an inner location. Thus, when the screw is turned it moves the gear means vertically between the radial extensions.

BRIEF DESCRIPTION OF THE DRAWINGS

The present invention fill be described in connection with the accompanying drawings, which illustrate the preferred embodiments and details of the invention, and in which.

DETAILED DESCRIPTION OF THE PREFERRED EMBODIMENT

Figure 1:
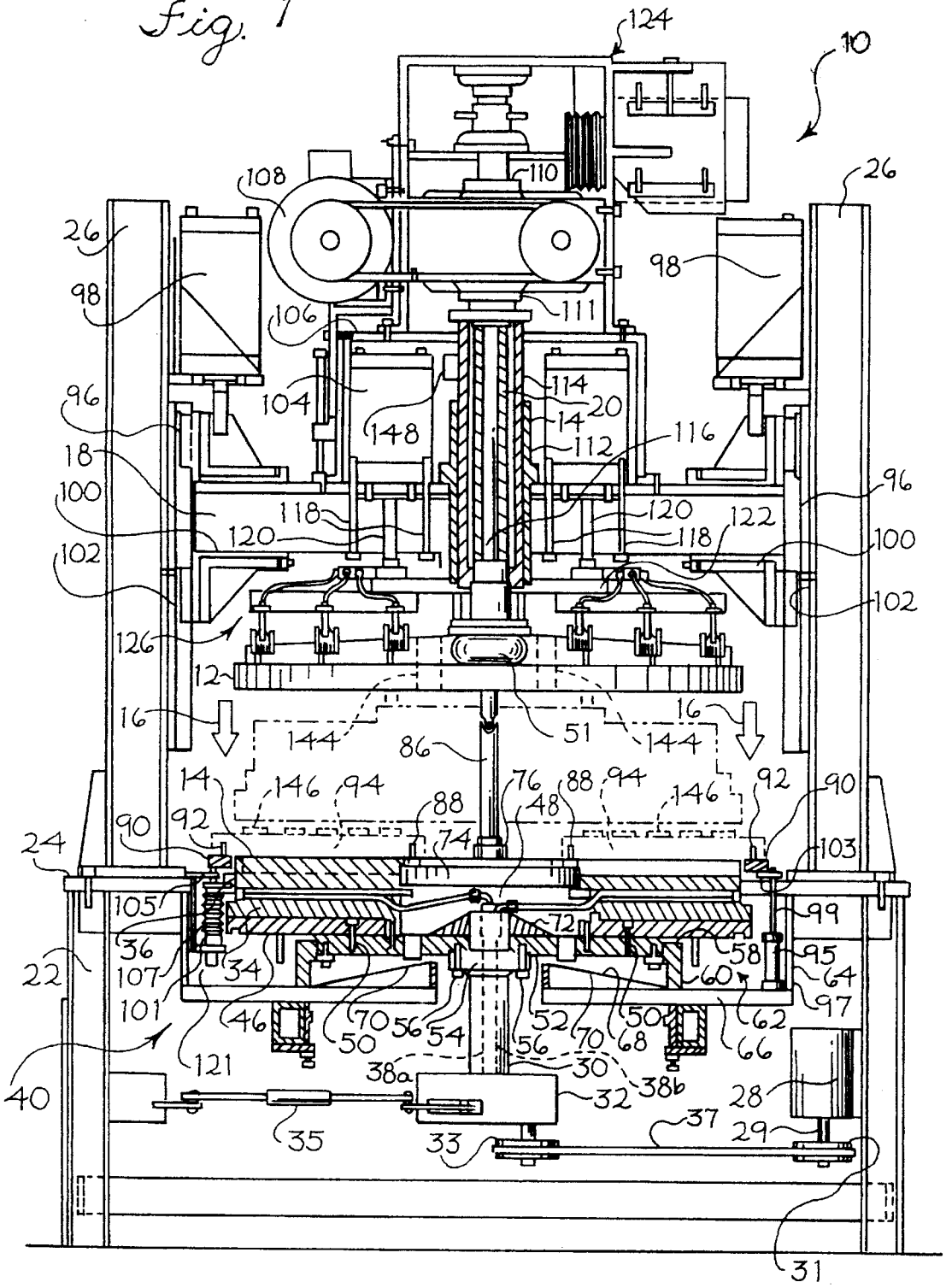
FIG. 1 is a front, partially sectioned, elevational view of a machine illustrating a dual column design in accordance with the present invention.

As shown in the drawings for purposes of illustration, the present invention provides a machine 10 capable of having a low silhouette to give greater rigidity and control when performing precision abrading processes, such as lapping and finishing. The following is referenced to a machine for performing lapping cycles, but applies also to a machine for other machining operations, such as fine finishing and polishing cycles.

Illustrated in FIG. 1 is a complete machine 10 in accordance with the present invention. The machine includes an upper machining plate 12, or upper lap plate, and a lower machining plate 14, or lower lap plate, wherein the upper lap plate 12 moves between an upper position for loading and unloading and a lower position for performing a lapping cycle (as indicated by the arrow given reference numeral 16. The travel distance between these such positions is done so to minimize cantilevering and to increase overall rigidity and control during the lapping cycle. That is, the machine employs a dual column design to minimize cantilevering during the lapping cycle and a moveable bridge 18, or carriage means, with an extendable spindle 20, or shaft, moveable relative to the bridge 18 to reduce the travel distance of the upper lap plate 12 relative to its overhead support (i.e., the bridge 18, and thereby reduces spindle extension which increases rigidity and control during the lapping cycle.

More particularly, the machine 10 includes a base 22, or frame, having a circular table top 24 and supporting a pair of upright hollow standards 26, or columns. Within the base 22, there is an electrical reversible motor 28, such as a 20 H.P. reversible motor, adapted to rotate a shaft 30 through a suitable gear box 32, such as a large planetary type shaft mounted gear box. More specifically the motor 28 drives a motor shaft 29 having a sheave 31 at its end. The sheave 31 is interconnected to a sheave 33, which communicates with the gear box 32, by at least one belt 37. Hence, the motor 28 drives the shaft 30 through the belt 37 and the gear box 32. Also, there is provided an adjustable threaded linkage 35 to adjust belt tension. The shaft 30, in turn, is adapted to rotate the lower lap plate 14, which has a ring-shaped configuration.

As shown, the lower lap plate 14 is mounted on an intermediate plate 34 that houses a cooling tube 36 which may be made of copper, or any other suitable non-flexible material. The coil tube 36 is wound about in a spiral configuration to cover most of the lower lap plate's underside surface and may be mounted to the lower lap plate 14 or the intermediate plate 34 by mounting screws (not shown). The coil tube 36 supplies coolant flow adjacent the lower lap plate 14 to control plate temperature during the lapping cycle and allows the use of coolant fluid under high pressure for faster cooling without distorting the lapping surfaces because it is made from a suitable non-flexible material. A pair of supply lines 38*a* and 38*b* extend upward into the lower lap plate assembly 40 through the shaft 30 to supply the coolant fluid, such as water and like, to the coil tube 36. The coil tube 36 is advantageous in the area of maintenance. For instance, it is easy and efficient to replace and repair because it does not require "O" rings or gaskets associated with chamber cooling systems.

Figure 4:
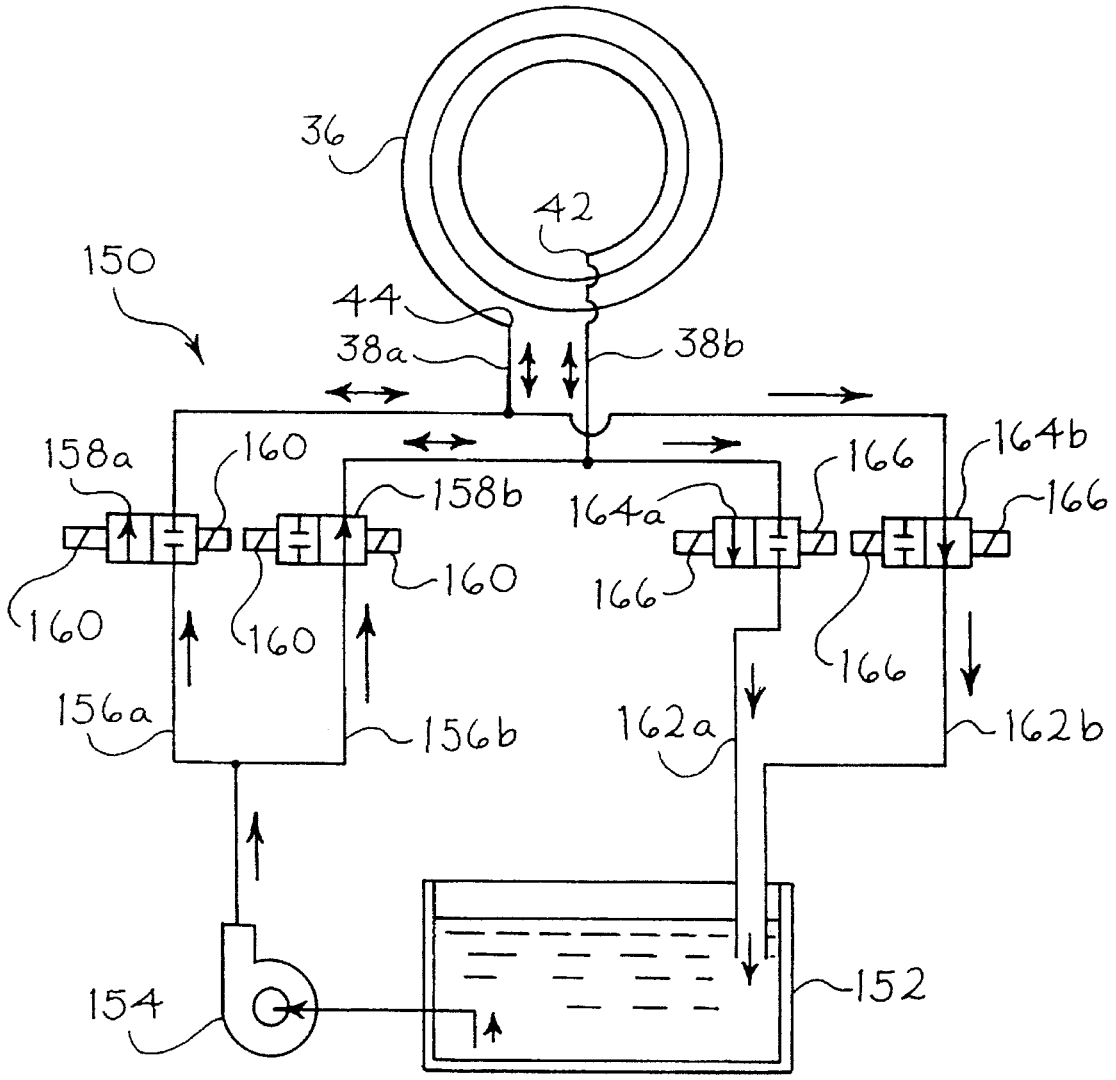
FIG. 4 is a schematic view illustrating a cooling system design in accordance with the present invention.

As illustrated in FIG. 4, the coil tube 36 includes an inner coil end 42, located at the center of the plates, and an outer coil end 44, located adjacent the outer edge of the plates. Since many lap plates can be as large as 50 inches in diameter, cold regions at the center of the lap plates tend to occur when coolant is supplied to such center region first. However, to prevent such cold regions, the present machine provides a coolant system which reverses the direction of the coolant flow (i.e., toggles the direction of the coolant flow) to provide a more even lapping plate temperature across the entire lapping surfaces of the lapping plates. That is, the coolant direction may initially flow from the inner coil end 42 to the outer coil end 44, and then at some predetermined point, or time sequence (e.g., continually or intermittently), which may be dependent on the temperature of the lapping plates, the flow may be reversed so to initiate at the outer coil end 44 and head towards the inner coil end 42. Thus, the coolant would start at the outer region of the lap plates. The toggling of the coolant's direction may be continued as necessary so as to balance the temperature more uniformly across the plates.

More particularly, the cooling system 150 includes the coil tube 36, which may be wound with an "Archimedes Spiral" configuration, a coolant supply tank 152, a supply pump 154, two coolant supply lines 156*a* and 156*b*,having each a 2-way directional control valve 158*a* and 158*b* with two solenoid actuators 160, and two coolant return lines 162*a* and 162*b*, having each a 2-way directional control, valve 164*a* and 164*b* with two solenoid actuators 166. The lines 38*a* and 38*b* interconnect the coil tube 36 with the supply lines 156*a* and 156*b*, respectively. The coolant is stored in the supply tank 152 where it is maintained at a predetermined temperature, such as 55 degrees Fahrenheit. The supply pump 154 pumps the coolant from the supply tank 152 into and through the coolant supply lines 156*a* and 156*b*, the coil tube 36 and the coolant return lines 162*a* and 162*b*.

The flow direction of the coolant determines which end of the coil tube 36 the coolant initiates, and therefore which line, either line 38*a* or line 38*b* supplies the coolant. More specifically, the 2-way directional control valves 158*a*, 158*b*, 164*a* and 164*b* control whether the coolant enters the coil tube 36 at the inner coil end 42 (via line 38*b*), and exits the outer coil end 44 (via line 38*a*), or enters the coil tube 36 at the outer coil end 44 (via line 38*a*), and exits the inner coil end 42 (via line 38*b*). For instance, to send coolant to the inner coil end 42 first the valve 158*b* of the coolant supply line 156*b*, connected to the inner coil end 42 by line 38*b*, is set to its open position by its actuator 160, and the valve 164*b* of the coolant return line 162*b*, connected to the outer coil end 44 by line 38*a*, is set to its open position by its actuator 166. This means that the other two valves 158*a* and 164*a* are set to their closed position by their respective actuator 160 and 166. To switch directions for sending coolant to the outer coil end 44 first, the actuators 160 and 166 switch the position of the valves 158*a*, 158*b*, 164*a* and 164*b*, whereby the coolant direction is reversed. The coolant supply pump 154 may run continuously with an electrical time employed to control the length of time the valves 158*a*, 158b, 164*a* and 164*b* are open or closed. This length of time may be configured front the temperature of the lapping plates during the lapping cycles.

As pan of the lower lap plate assembly 40, a lower sub-plate 46 is located below the intermediate plate 34 for supporting the lower lap plate 14. Crossing a center opening 48 of the lower lap plate 14 and connected by screws 50 to the sub-plate 46 is a driven coupling plate 52, or a large diameter precision turntable bearing, which interconnects the shaft 30 to the lower lap plate assembly 40 for rotation. This driven coupling plate 52 is connected at the upper end of the shaft 30 through a mounting coupling 54 and screws 56 and is supported at its outer edge 58 by bearings 60. More particularly, the outer edge 58 of the coupling plate 52 terminates approximately below the outward radial center of the lower lap plate 14, and thus the bearings 60 provide support to the lap plate 14 at a critical position so as to prevent bending thereof while under operating pressures.

A well 62 is formed around the underneath of the lower lap plate assembly 40 by an annular vertical partition 64 and a circular horizontal partition 66 having a fluid guide ramp 68, and it is into this well 62 that the abrasive fluid will flow through centrifugal force created by the rotation of the lap plates 12 and 14 during normal operation of the lapping cycle. The center 48 of the lower lap plate 14 is closed and sealed by the intermediate plate 34, the lower sub-plate 46 and the coupling plate 52 of the lower lap plate assembly 40 so that there is no access to the shaft 30, the gear box 32, or the motor 28 contained within the base 22. The coupling plate 52 has a number of apertures 70 adjacent a small fluid guide ramp 72 surrounding the upper end of the shaft 30 inside the lower lap plate assembly 40 to guide the excess abrasive fluid to access the well 62 above the ramp 68, which directs it into the well 62.

Figure 5:
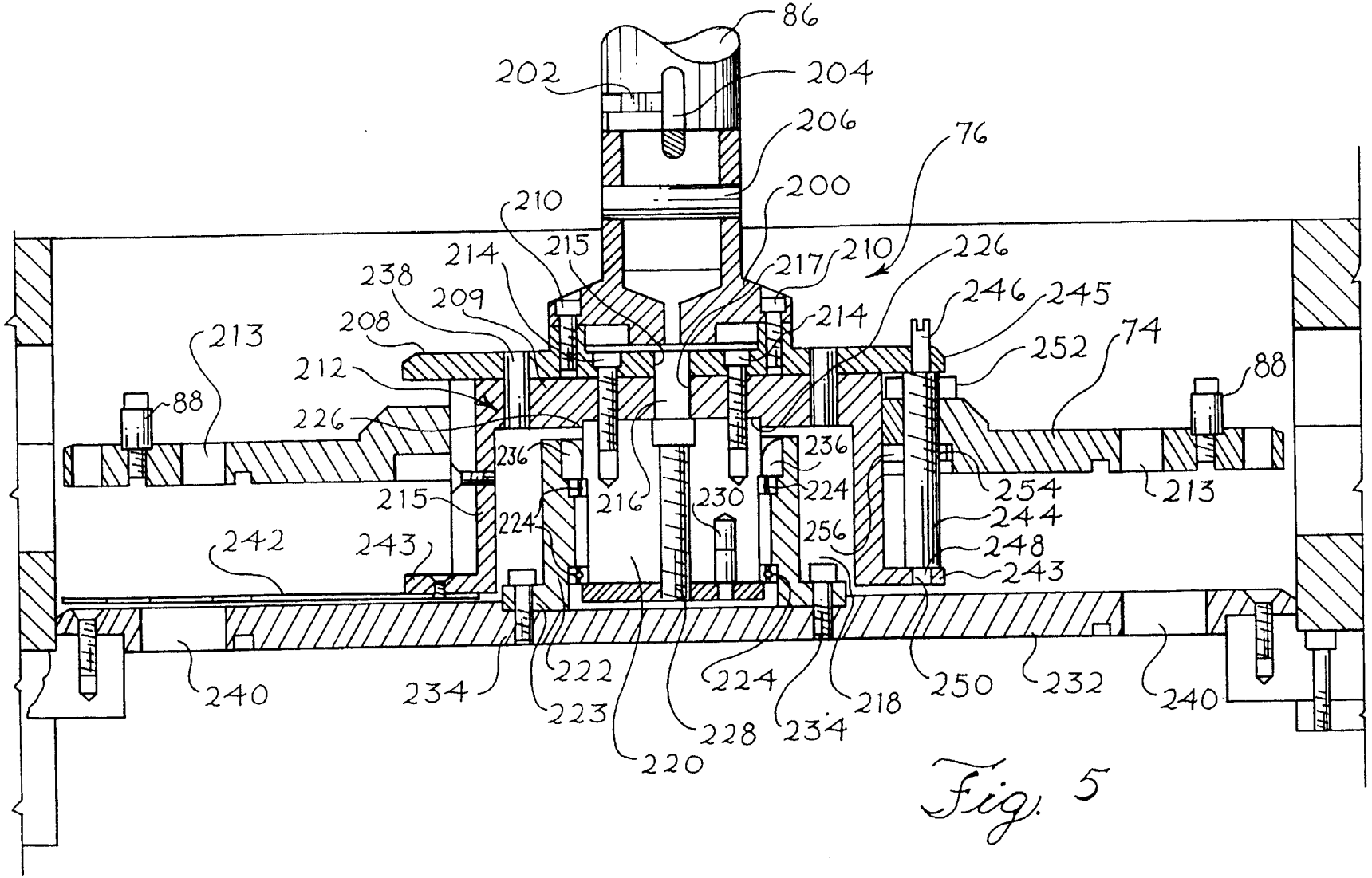
FIG. 5 is a cross-sectional view of a drive coupling assembly in accordance with the present invention.

Also positioned within the center opening 48 of the lower lap plate 14 is a circular inner, or center, drive gear 74. As best illustrated in FIGS. 1 and 5, the center drive gear 74 provides a plurality of equally distant drive pins 88, about the periphery of the center drive gear 74. Mounted about the periphery of the lower lap plate 14 is an outer gear ring 90 that supports a plurality of equally distant gear pins 92 about its periphery. A plurality of gear-like work carriers 94 can then be placed on the lower lap plate 14 in contact with the drive pins 88 and the gear pins 92 for being driven by the center gear 74 for rotation therewith in the plane of the lap surface of the lower lap plate 14 independently of the rotation of the lap plates 12 and 14. More particularly, each of the gear-like work carriers may be substantially circular and have a plurality of apertures adjacent its outer periphery or perimeter to receive the drive pins 88 and gear pins 92, and each of the work carriers carries at least one workpiece, and it is preferred that at least four work carriers be used in the machine of the present invention for operation.

The outer gear ring 90 moves in a vertical motion actuated by a plurality of air cylinders 95. In the preferred embodiment, there may be three commercially available air cylinders 95 located approximately 120 degrees apart and may provided as much as 2.5 inches of vertical movement. More particularly, each air cylinder 95 is fixed at its lower end 97 to suitable structure of the machine which enables support, such as the horizontal partition 66 forming the well 62. At its upper end, each cylinder 95 has its air cylinder plunger 99 adapted with an actuator arm 103 extending therefrom to engage to raise and lower the outer gear ring 90. This vertical action allows workpieces 146 and/or work carriers 94 to be removed from the lower lap plate 14 by enabling the outer gear ring 90 to descend below the height of the lower plate's lapping surface.

The smoothness of this action is attributed to a plurality of ball bushing guide rails 101. In the preferred embodiment, there is provided three ball bushing guide rails 101 located approximately 120 degrees apart about the outer gear ring 90 and alternatively located between the air cylinders 95. More particularly, each ball bushing guide 101 is mounted at its lower end 121 to suitable structure for support, and its upper end is adapted with a support arm 105 extending therefrom to engage and support from underneath the outer gear ring 90. Each ball bushing guide 101 includes a suitable commercially available assembly, such as a Thomson bearing assembly and has its shaft protected by an outer shaft protection bellow 107.

For driving the center drive gear 74, there is provided a drive coupling cup assembly 76 which interconnects the center drive gear 74 to a driven spindle 86 which in turn drives the center drive gear 74 by way of an overhead motor mounted to the bridge 18. To rotate the spindle 86, there is provided a sprocket located at the spindle's upper end which is driven by a chain that interconnects the sprocket with the motor having a motor shaft fitted with another sprocket mounted above for movement therewith the bridge 18.

More particularly, as illustrated in FIG. 5, the drive coupling cup assembly 76 includes a first hub 200 for mounting the drive spindle 86 to the assembly 76. More specifically, the spindle 86 slips into the first hub 200 and is secured therein by a plurality of keyways and locking keys 202, 204, and 206. The first hub 200 is mounted upon a top cap plate 208 by a number of screws 210 located circumferentially about the first hub 200. The top cap plate 208 is in turn mounted upon a second hub 212 by a number of screws 214 located more centrally relative to the center of the top cap plate 208 than the screws 210. A centering dow pin 216 extends through aperture 215 and aperture 217 of the top cap plate 208 and the second hub 212, respectively, to center them relative to one another.

The second hub 212 includes a hub side wall 215 and a top wall 209 defining an internal cavity 218 in which is located a center spacing shaft 220 upon which the second hub 212 rests and rotates therewith. More particularly, the center spacing shaft 220 is located centrally and enables the drive coupling cup assembly 76 to rotate therewith the shaft 86. For centrally locating the center spacing shaft 220 with the second hub 212, there is provided a recess 226 formed in the underneath side of the top wall 209 of the second hub 212. The upper end of the center spacing shaft 220 fits snugly into the recess 226 to locate and prevent lateral movement, such as wobbling.

A third hub 222 maintains the center spacing shaft 220 for rotation therein by a number of bearings 224. The third hub 222 includes a lower annular mounting flange 223 which is mounted to a lower center plate 232 by a number of screws 234. The lower center plate 232 may be mounted to the intermediate plate 34 for rotation with the lower lap plate assembly 40. An assembly screw 228 holds the center spacing shaft 220 and the bearings 224 tightly together in its assembly, and an anti-turning pin 230 prevents turning as the screw 220 is tightened. To protect the bearings 224 from damaging elements, such as abrasive slurry matter, a mechanical seal 236 is disposed between the third hub 222 and the center spacing shaft 220 above the bearings 224 and is also held in place by the assembly screw 228.

The coupling cup assembly 76 includes a number of apertures 238 which extend through the top cap plate 208 and the second hub 222 into the cavity 218 for enabling abrasive slurry and the like to drain down and upon to the lower center plate 232. Also, the center drive gear 74 includes a plurality of apertures 213 for enabling excess slurry material to fall down upon the lower center plate 232. Slurry which falls onto the lower center plate 232 is directed into a number of drain apertures 240 by a slurry wiper blade 242 attached to, and extending radially from, a lower annular flange extension 243 of the second hub 212 for rotation therewith. As the second hub 212 rotates, the wiper blade 242 moves over the lower center plate 232 and directs the slurry into the drain apertures 240.

To interconnect the center gear 74 with the drive coupling cup assembly 76 for rotation therewith the spindle 86, the drive coupling cup assembly 76 includes a number of precision adjustment screws 244 which extend through the center gear 74 at its inner region. The screws 244 enable the center gear 74 to be adjusted vertically to accurately accommodate for thickness changes of the lower lap plate 14. Preferably, three precision adjustment screws 244 are provided and located approximately 120 degrees about the circumference of the inner region of the center gear 74.

More particularly, the screws 244 extend through the top cap plate 208 adjacent its outer radial edge 245, which extends beyond the side wall 215 of the second hub 212, and the center gear 74 and down to rest on the lower flange extension 243 of the second hub 212. Each screw 244 has an upper turning end 246, with reduced diameter, which extends through and above the top cap plate 208 and which may be adapted for being turned by a tool, such as a screwdriver to make the requisite adjustments. At the other end, each screw 244 has a lower, reduced diametered end 248 which sits in an aperture 250 through the lower flange extension 243 for rotation therein.

Each screw 244 may be threaded to interact with the center gear 74 to raise and lower the center gear 74 between the top cap plate 208 and the lower flange extension 243. More particularly, a locking nut 252 rides on the screw 244 directly above the center gear 74, and a half moon nut 254 straddles the second hub 212 and also rides the screw 244 directly below the center gear 74. The half moon nut 254 is located in an annular recess 256 about the second hub 212 formed in the bottom side of the center gear 74. The half moon nut 254 prevents binding of the center gear 74 with the second hub 212 when one screw 244 is being turned at a time.

Returning to FIG. 1, each of the columns 26 is supported vertically by the base 22 at the table top 24 and includes a linear ball bearing slide assembly 96 for mounting the bridge 18 for vertical movement therebetween. An air cylinder 98 is mounted to each column 26 above the slide assemblies 96 and simultaneously drives the bridge 18 vertically between the two columns 26. For locking the bridge 18 at a particular vertical location, such as in the upper position the bridge 18, adjacent its connection with the columns 26, is provided with a safety locking mechanism 100 at each column 26 which prevents the bridge 18 from sliding unintentionally. The locking mechanism 100 may be either spring loaded pins or actuated cylinders, wherein the cylinder shaft engages locking holes formed in corresponding complementary brackets 102 mounted to the columns.

The upper lap plate 12, which has a ring-like configuration, is supported by the bridge 18 for vertically movement relative to the bridge 18. A pair of air cylinders 104 drives such movement and also supplies pressure during the lapping cycle. The air cylinders 104 are contained in a housing 106 which is mounted to the bridge 18. The spindle 20 is driven by a motor 108 mounted above, and moveable with the bridge 18, to rotate the upper lap plate 12, and bearings 110 are supplied for the shaft 86 and bearings 111 for the spindle 20.

To guide the vertical movement of the upper lap plate 12, a pair of vertically extending, telescoping sleeves 112 and 114 are provided, wherein the outer sleeve 112 is fixed to the bridge 18 against movement and defines a travel aperture 116 through the center of the bridge 18, and the inner sleeve 114 slides inside the outer sleeve 112 with movement of the upper lap plate 12. Also, the upper lap plate 12 is provided with a ball swivel 51 to allow the upper lap plate 12 to align with the lower lap plate 14. The spindles 20 and 86 for rotating the upper lap plate 12 and the center drive gear 74, respectively, both extend through the sleeves 112 and 114.

More particularly, the air cylinders 104 for driving the vertical movement of the upper lap plate 12 are mounted on top of the bridge 18 with mounting screws 118, and each has a cylinder rod 120 extending down through the bridge 18 on each side of the sleeves 112 and 114. The cylinder rods 120 attach to a coupling plate 122, or carrier plate, which in turn is secured to the inner sleeve 114 and the upper lap plate assembly about the spindle 20. Thus, the cylinders 104 are able to reciprocate vertically, and apply pressure to, the upper lap plate 12, which is also being guided against lateral displacement by the movement of the inner slave 114 in and against the outer slave 112.

More specifically, a pneumatic pressure system (not shown), which includes the air cylinders 104, may be employed to regulate pressure applied to the upper lap plate 12. Incorporated in this system, there may be an electronically controlled proportion air valve (not shown) which regulates and maintains the proper pressure, controlled by an electronic pressure transducer sensor (not shown), and programmable controller (not shown). To eliminate the upper lap plate 12 and spindle 20 weight as a factor in the pressure system, a counterbalance pressure system (not shown) may be utilized and activated by an electronic proximity switch (not shown).

The center drive gear 74 is driven from the top of the machine 10 by the shaft 86, which is a spindle shaft and is powered by a drive mechanism 124 mounted to the sliding bridge 18. The drive mechanism 124 and the mechanism for driving the spindle 20 of the upper lap plate 12 are both mounted to the bridge 18 for movement therewith and include sprockets mounted to the spindles and chains interconnecting the motors having drive shafts with sprockets themselves and, otherwise, may be that disclosed in Day '312 and therefore is incorporated herein by reference. Three independent variable speed electronic drives control upper plate speed, center gear speed and lower plate speed. This allows for better control of lapping plate flatness. Additionally, the center gear drive 74 changes its rotation direction at the start of each new lapping cycle. The plate flatness is extended because of this action.

Grain size or mesh size of the abrasive fluid or slurry controls the surface finish. The abrasive fluid feed system (not shown) consists of a variable speed peristaltic pump (not shown), for positive abrasive fluid supply to the lapping area. A stationary abrasive fluid supply tank (not shown) is used with a constant mixing unit (not shown) controlling the proper suspension of the abrasive fluid mixture.

Figure 3:
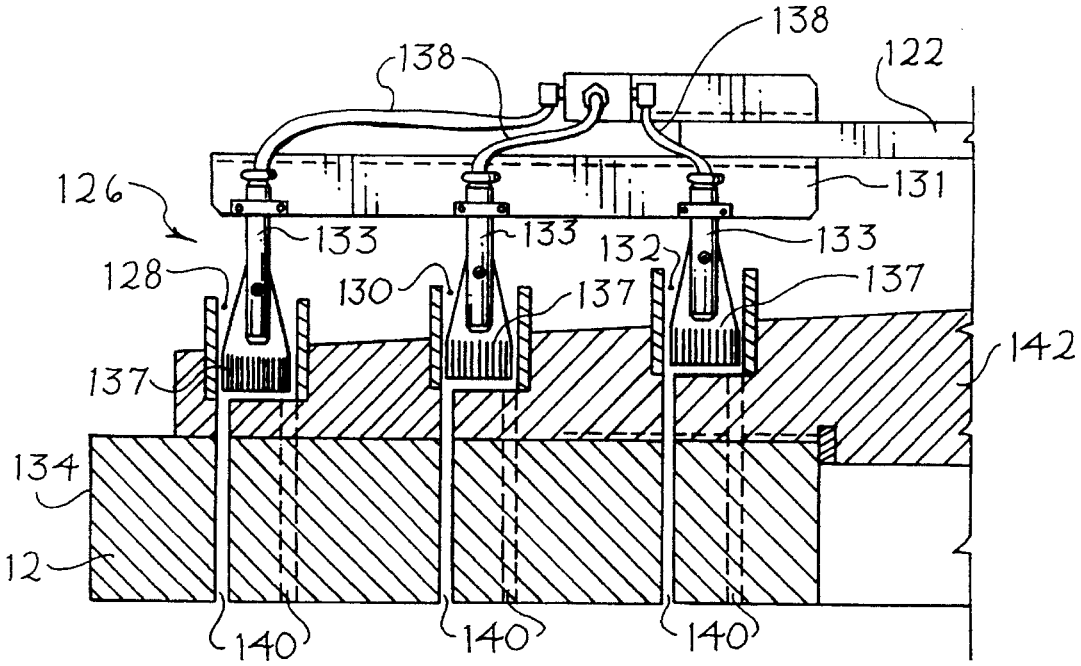
FIG. 3 is a cross-sectional view taken along the line 2—2 of FIG. 2.
Figure 2:
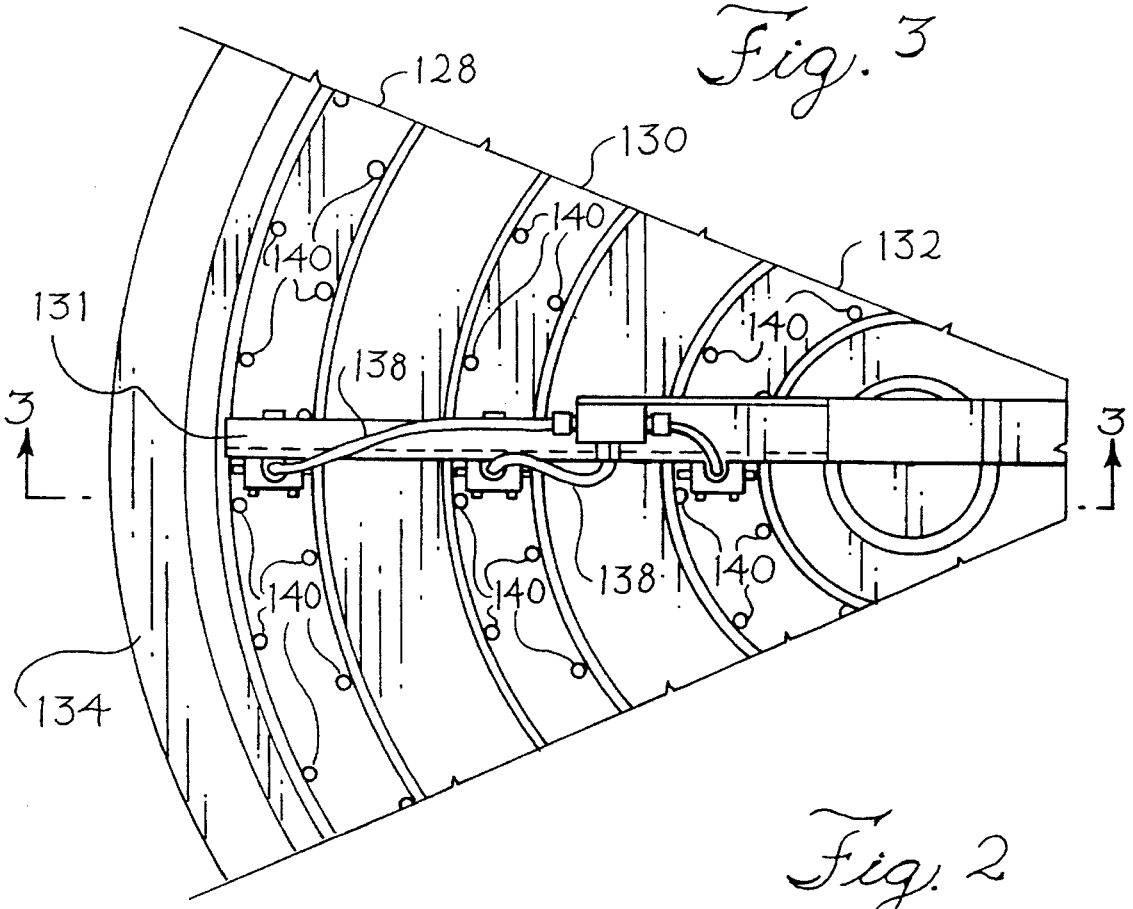
FIG. 2 is a partial top plan view of the upper lap plate assembly of the machine of FIG. 1 illustrating an abrasive fluid distribution system in accordance with the present invention.

The upper carrier plate 122 located above, and moveable therewith, contains an abrasive fluid distribution system 126 as pan of the feed system for uniformly distributing the fluid to the lapping area between the lapping plates 12 and 14. As best illustrated in FIGS. 2 and 3, the system 126 includes a circular trough plate 142 with decreasing thickness as proceeding radially outward and having three concentric, circular abrasive fluid troughs 128, 130 and 132 (i.e., an outer, intermediate and inner trough, respectively), as viewed in plan (FIG. 2), and each has a square tubular design, as viewed in cross-section (FIG. 3). The troughs 128, 130 and 132 are spaced relative to one another by distances which may be referenced from the outer edge 134 of the upper lap plate 14. These distances increase uniform flow to the lapping area. Additionally, the outer trough 128 is located closer vertically to the lower lap plate 12 than the intermediate trough 130 and the intermediate trough 130 closer than the inner trough 132.

For instance, in a lapping plate having a 52 inch diameter, the three troughs, each having about a 2-inch width, may be spaced as follows: the outer edge of the outer trough may be spaced approximately 3 inches inward from the outer edge of the upper lap plate: the intermediate trough may be spaced 3.5 inches inside of the inner edge of the outer trough; and the inner trough may be spaced 3.5 inches inside of the inner edge of the intermediate trough.

Each of the troughs 128, 130 and 132 is supplied at two locations about 180° apart (FIG. 1). At each location, an arm 131, extending radially outward from the carrier plate 122 supports a downward directed nozzle 133 for each trough 128, 130 and 132. Each nozzle 133 directs slurry into its respect trough and is supplied itself by a fluid supply tube 138. A brash 137 is mounted from each nozzle 133 to depend down into the trough to move the slurry about each respective trough. Each of the slurry supply robes 138 is controlled by a valve for feeding the proper amount of abrasive fluid to the trough. The supply tube, for example, may be flexible tubing which may be controlled by a pinch valve.

It may be desirable to increase the flow going to the outer trough 128 relative to the other two troughs 130 and 132, for it is the largest in area and coverage and likewise, increase the flow to the intermediate trough 130 relative to the inner trough 132. Holes 140 through the trough plate 142 and upper lapping plate 12 bring the abrasive fluid to the lapping area. The holes 140 of each trough may be staggered from another as illustrated in FIG. 2 for increasing uniform abrasive fluid distribution.

As illustrated in FIG. 1, the upper lap plate 12 has a plurality of equidistantly spaced holes 144, or chimneys, extending through it and the trough plate 142, around where the spindle 20 attaches thereto. Preferably, there are at least three such holes. The holes 144 vent pressure by releasing heat during the lapping cycle. This prevents the heat and steam from being forced up the shaft 20 to the bearings, drive mechanisms and other systems located above, and thereby reduces damages to such above systems.

In operation, the machine 10 is controlled by a main control center (not shown) which may utilize a touch screen system (not shown). This main control center eliminates numerous satellite controls which would require additional hard wiring. One known suitable touch screen system is the Smart Touch™ system by TCP of Melrose Park, Ill.

The machine 10 is initially set with the upper lap plate 12 and bridge 18 in its upper position for loading. The workpieces 146 are contained within a configuration conforming to the outline of the workpieces 146 which are located in the work carriers 94. The work carriers 94 are then equally spaced around the center drive gear 74, and the outer ring gear 90 maintains and guides the work careers 94 in their circular motion. Thus, the work carriers 94 are positioned between the upper lap plate 12 and the lower lap plate 14, whereby each lap plate may perform an abrading function on the workpieces 146 carried by such work carriers 94.

After loading the machine 10, the bridge 18 is lowered by the two air cylinders 98 by sliding it down between the two columns 26 via the linear ball bearing slides 96. When in the lower position, the bridge 18 stops at a definite predetermined position. Next, the upper spindle 20 containing the upper lap plate 12, powered by the two air cylinders 104, slides down upon the workpieces 146 with a minimum extension of the spindle 20. This allows greater pressure to be applied upon the workpieces 146 with less lateral strain upon the spindle assembly 20.

In the lowering process, the bridge 18 movement travels most of the distance between the upper loading and unloading position and the lower lap plate 14 itself. This travel of the bridge 18 is preferably a fixed distance. The upper lap plate 12 travels a much less variable distance to come in contact with the workpieces 146 without extending its spindle 20 very much.

For instance, in the preferred machine 10, the upper lap plate 12 is about 15 inches from the lower lap plate 14 when in the upper position, and the bridge 18 travels about 11 inches to move the upper lap plate 12 approximately 4 inches from the lower lap plate's lapping surface. The upper lap plate 12 travels the remaining distance, which is approximately 4 inches characteristics of the lap plates 12 and 14, such as wear reduction on thickness.

A sensor system 148 having an electronic linear scale, such as a Sony™ eight inch linear scale, model number GS-20E, may be employed to sense the travel of the upper lap plate 12. Additionally, a display unit, such as a Sony™ Digital Position Readout System, model number LU10A, may be used in connection with the electronic linear scale to display the position sensed by the scale. However, any other suitable electronic linear scale and display unit providing the same feature and functions may be employed and be within the scope of the present invention.

More specifically, the liner scale of this system 148 may be mounted so to sense the sliding of the telescopic sleeves 112 and 114. In particular, it may sense the travel of the inner slave 114 relative to the outer sleeve 112. The system 148 is capable of starting measurements from any position to compensate for differences in the upper lap plate 12 travel due to wet of the lap plates 12 and 14. It therefore is not necessary to preset the system 148 for lap plate thicknesses. This system 148 overall increases control and rigidity of the machine 10.

The required lapping pressure is applied upon the workpieces 146 by the air cylinders 104 through the upper spindle 20 and the upper lap plate 12. The lower lap plate 14 makes up the other half of the pressure. Through the drive arrangement hereinbefore described the upper lap plate 12 may be caused to rotate in one direction while the center drive gear 74 may be rotated in an opposite direction. Both of the rotational movements may be varying with each other as well as the speed of the lower lap plate 14. Thus, pressure, pan rotation, and upper and lower plate rotation combine with the abrasive fluid to remove the desired amount of material from the workpieces 146. After the lapping is completed, the upper lap plate 12 is raised, and then, the bridge 18 is raised to provide access for unloading the workpieces 146.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A device for performing abrading operations on a plurality of workpieces, the device comprising:

an upper and lower lap plate, each having an annular lapping surface parallel to each other;

means for rotating each of the lap plates about its own vertical axis;

means for carrying workpieces on the lower lap plate;

carriage means for supporting the upper lap plate for vertically reciprocating movement relative thereto;

a frame means for supporting the carriage means at spaced locations for vertically reciprocating movement;

means for driving the vertically reciprocating movement of the carriage means being mounted to the frame means and connected to the carriage means to move the upper lap plate relative to the lower lap plate for performing abrading operations and to load and unload the workpieces; and means for driving the vertically reciprocating movement of the upper lap plate relative to the carriage means for cooperating with the vertical movement of the carriage means for positioning the upper lap plate to perform abrading operations.

2. A device in accordance with claim 1 which further comprises a plurality of vertically disposed and laterally displaced columns for supporting the carriage means for vertical movement, each column having means for mounting the carriage means therebetween for vertical movement.

3. A device in accordance with claim 2 wherein the means for mounting the carriage means further comprises linear bearings mounted to each column and where the carriage means is attachable to the linear bearings for effectuating vertical movement.

4. A device in accordance with claim 1 wherein the means for moving vertically the upper lap plate relative to the carriage means further comprises a pair of telescopically related guide sleeves, wherein a first sleeve is fixed to the carriage means and a second sleeve is located inside the first sleeve to slide thereagainst to prevent lateral displacement of the upper lap plate, a drive shaft extending through the sleeves and being freely embraced by the sleeve for vertical movement therein to move the upper lap plate relative to the carriage means and means for driving the vertical movement of the lap plate relative to the carriage means.

5. A device for performing abrading operations on at least one workpiece, the device comprising:

an upper and lower lap plate, each having a lap surface parallel to each other:

means for rotating each of the lap plates about its own vertical axis;

gearlike work carrying means carried on the lower lap plate;

gear means in the plane of the lap surface of the lower lap plate for rotating the gearlike work carrying means relative to the lap surfaces independently of the rotation of the lap plates:

carriage means for supporting the upper lap plate that is being driven by the rotating means:

a frame means for supporting the carriage means at spaced locations for vertically reciprocating movement;

means for driving the vertically reciprocating movement of the carriage means being mounted to the frame means and connected to the carriage means to move the tipper lap plate relative to the lower lap plate for performing abrading operations and to provide access for loading and unloading the workpieces:

an overhead drive means for the gear means carried by the carriage means and including a rotatable drive shaft freely journalled through the center of the upper lap plate and the carriage means and being connected to the gear means for rotating the same in the plane of the lap surface of the lower lap plate independently of the rotation of the tipper and lower lap plates.

6. A device in accordance with claim 5 which further comprises means for adjusting vertically the gear means to maintain the gear means in the plane of the lap surface of the lower lap plate as the lower lap plate diminishes.

7. A device in accordance with claim 6 wherein the means for adjusting vertically the gear means comprises at least one screw mounted to the device and being communicatable with the gear means to raise and lower the gear means as the screw is turned.

8. A device in accordance with claim 7 which further comprises a hub assembly for connecting the rotatable drive shaft of the overhead drive means to the gear means for rotating the gear means, the hub assembly comprising an upper radial extension, a lower radial extension, and a hub wall located between the radial extensions and beyond which the radial extensions extend and the gear means surrounds the hub wall, and the at least one screw extends between the radial extension and through the gear means to raise and lower the gear means as the at least one screw is turned.

9. A device in accordance with claim 8 wherein the radial extensions extend annularly about the hub assembly and the at least one screw includes three screws disposed equidistantly and circumferentially about the inner region of the gear means.

10. A device in accordance with claim 9 which further comprises a half moon nut which straddles the hub wall and engages the gear means from underneath to allow the gear means to be raised by turning one screw at a time without binding on the gear wall.

11. A device in accordance with claim 5 wherein the gear means comprises a circular plate, the circular plate having a plurality of drive pins set in openings formed about the periphery of the plate with the pins extending above the lap surface of the lower lap plate for engaging the gearlike work carrying means.

12. A device in accordance with claim 11 wherein the gearlike work carrying means includes at least four substantially circular gearlike carriers for carrying at least one workpiece each, each gearlike work carrier having a plurality of apertures adjacent its outer perimeter for being engaged by the plurality of drive pins of the circular plate.

13. A device for performing abrading operations on at least one workpiece, the device comprising:

an upper and lower lap plate, each having a lap surface parallel to each other;

means for rotating each of the lap plates about its own vertical axis;

means for carrying at least one workpiece on the lower lap plate;

carriage means for supporting the upper lap plate that is being driven by the rotating means;

a frame means for supporting the carriage means at spaced locations for vertically reciprocating movement;

means for driving the vertically reciprocating movement of the carriage means being mounted to the frame means and connected to the carriage means to move the upper lap plate relative to the lower lap plate for performing abrading operations and to provide access for loading and unloading the workpieces;

means for controlling temperature of the lap plates; and means for supplying abrasive fluid to the device for performing abrading operations.

14. A device for performing abrading operations on at least one workpiece, the device comprising:

an upper and a lower lap plate, each having a lap surface parallel to each other;

means for rotating each of the lap plates about its own vertical axis;

means for carrying at least one workpiece on the lower lap plate;

carriage means for supporting the upper lap plate that is being driven by the rotating means;

a frame means for supporting the carriage means at spaced locations for vertically reciprocating movement;

means for driving the vertically reciprocating movement of the carriage means being mounted to the frame means and connected to the carriage means to move the upper lap plate relative to the lower lap plate for performing abrading operations and to provide access for loading and unloading the workpieces;

means for reciprocating the upper lap plate independent of and relative to the carriage means for performing abrading operations and to provide access for loading and unloading the workpieces; and wherein, for performing abrading operations and to provide access for loading and unloading the workpieces from the device, the carriage means travels vertically a first predetermined distance relative to the lower lap plate and the upper lap plate travels vertically a second predetermined distance relative to the carriage means, with the first predetermined distance being greater than the second predetermined distance.

15. A device for performing abrading operations on at least one workpiece, the device comprising:

an upper and a lower lap plate, each having a lap surface parallel to each other;

means for rotating each of the lap plates about its own vertical axis;

means for carrying at least one workpiece on the lower lap plate;

carriage means for supporting the upper lap plate that is being driven by the rotating means;

a frame means for supporting the carriage means at spaced locations for vertically reciprocating movement;

means for driving the vertically reciprocating movement of the carriage means being mounted to the frame means and connected to the carriage means to move the upper lap plate relative to the lower lap plate for performing abrading operations and to provide access for loading and unloading the workpieces;

the frame means further comprising a plurality of vertically disposed columns for supporting the carriage means for vertically reciprocating movement; and the reciprocating means comprising a set of bearings mounted to each column to which the carriage means attaches for effectuating vertical movement of the carriage means.

* * * * *

UNITED STATES PATENT AND TRADEMARK OFFICE

CERTIFICATE OF CORRECTION

PATENT NO. : 5,595,529

DATED : January 21, 1997

INVENTOR(S) : Joseph V. Cesna and Lawrence O. Day

It is certified that error appears in the above-indentified patent and that said Letters Patent is hereby corrected as shown below:

Column 13, line 51, change "tipper" to -- upper --.

Column 13, line 60, change "tipper" to -- upper --.

Signed and Sealed this

First Day of July, 1997

Bruce Lehman

*Attest:*

BRUCE LEHMAN

*Attesting Officer*

*Commissioner of Patents and Trademarks*